US005996849A

United States Patent [19]

Bansal

[11] Patent Number: 5,996,849

[45] **Date of Patent: *Dec. 7, 1999**

[54] TAMPER EVIDENT DISPENSING CLOSURE

[75] Inventor: Vinod Kumar Bansal, Edison, N.J.

[73] Assignee: Lipton, Inc., Englewood Cliffs, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,969

[22] Filed: Oct. 14, 1997

Related U.S. Application Data

[60] Provisional application No. 60/028,574, Oct. 16, 1996.

[51] Int. Cl.[6] ..... B67D 5/33; B67D 47/00; B67D 39/00

[52] U.S. Cl. ..... 222/153.06; 222/153.14; 222/556; 215/250; 215/253

[58] Field of Search ..... 222/153.06, 556, 222/153.05, 153.14, 557, 562, 563, 532; 215/250, 253, 256, 251

[56] References Cited

U.S. PATENT DOCUMENTS

| | | | |
|---|---|---|---|
| D. 320,746 | 10/1991 | Bolen et al. | D9/446 |
| D. 335,538 | 5/1993 | Deutsch et al. | D24/169 |
| 4,538,740 | 9/1985 | Peterson, Jr. | 215/256 |
| 4,993,606 | 2/1991 | Bolen et al. | 222/546 |
| 5,251,793 | 10/1993 | Bolen et al. | 222/546 |
| 5,395,015 | 3/1995 | Bolen et al. | 222/546 |
| 5,509,552 | 4/1996 | Eguchi et al. | 215/256 |
| 5,544,770 | 8/1996 | Travisano | 215/250 |
| 5,667,086 | 9/1997 | Guerre | 215/256 |
| 5,865,354 | 2/1999 | Bansal | 222/546 |

FOREIGN PATENT DOCUMENTS

| | | | |
|---|---|---|---|
| 1193299 | 11/1959 | France | 222/153.06 |

*Primary Examiner*—Kevin Shaver
*Assistant Examiner*—Keats Quinalty
*Attorney, Agent, or Firm*—James J. Farrell

[57] ABSTRACT

A tamper evident container with a dispensing closure is disclosed. The patent deals with a container having a smooth neck portion and having a removable dispenser closure mounted on the neck portion. The closure, in turn, is formed with a top, a skirt depending from the top and a dispensing lid mounted on the top. The top has a dispensing orfice in it which communicates with the interior of the container. The lid is moveable from a position closing the dispensing orifice to a position opening the dispenser orifice. A tamper evident neck wrap is mounted on the container over the skirt and the lid which prevents the dispensing lid from being moved to an open position without tearing or breaking the neck wrap to show the container has opened.

2 Claims, 2 Drawing Sheets

TAMPER EVIDENT DISPENSING CLOSURE

This application claims the benefit of U.S. Provisional application 60/028,574 filed Oct. 16, 1996.

FIELD OF THE INVENTION

The present invention generally relates to tamper evident dispensing closures.

BRIEF DESCRIPTION OF THE INVENTION

Currently there are two general ways to render dispensing closures on consumer bottles tamper-evident. The first of these is a combination of an inner seal in the cap to prevent material from being added when the lid is opened combined with a neck wrap to prevent complete removal of the cap. The second method is by employing a plastic shrink band or wrap which closes off the dispensing lid portion of the cap and also prevents complete removal of the cap. Both of these methods are relatively complex and a simpler method is desirable.

The instant invention is to provide a way to make a package with a dispensing cap which is tamper-evident without the need for an inner seal or shrink wrap. This is accomplished by extending the neck label onto the dispensing lid portion of the cap while adding an extension to the lid. The label so extended thus covers access to the lid on the dispenser cap. In order to gain access a portion of the neck label must be removed and this clearly reveals that access has occurred. This is a much simpler and less expensive way to make a package with a removable dispenser cap tamper-evident. This method could reduce the cost of a dispenser cap by as much as 25% to 50% and does not require any additional equipment on the filling line.

Dispenser caps or closures for selected consumer products contained in bottles such as salad dressing usually require two methods of opening the cap. First, it is desirable to allow complete removal of the cap to permit a user to pour out large quantities of product. Second, it is also desirable to permit a user to dispense controlled quantities of product by opening the lid of the cap and pouring through an appropriately sized dispensing orifice. This type of a dispensing cap can be called a shaker cap and a pour cap combination and is exemplified in many patents such as U.S. Pat. Nos. 4,993,606; 5,251,793; 5,395,015; Des. 320,746 and Des. 335,538. The cap requires two separate means of gaining access to the contents, so a single mechanism of tamper-evidency for both means is seen to be extremely desirable.

The dispenser closure of the invention requires dual access and dispensing and both means are covered with a neck wrap, preferably paper, which will clearly show evidence of any tampering. The lid of the cap opens through a thumb notch or by inserting a sharp prying object under it to open it. The second opening or dispensing means is achieved by removing or unscrewing the cap completely.

The prior art employed a neck wrap around the bottom of the cap so that the cap could not be unscrewed without breaking the neck wrap. In addition, the prior art employed an inner seal to prevent tampering through the dispenser lid or under the edge of the dispenser. A shrink wrap band could also be used around the whole cap but in order to do this an anchor would be required on the neck of the bottle. For a bottle having a neck where the skirt of the cap and the outside dimension of the bottle neck both lie close to or in a substantially continuous surface or on one continuous curved plane, it would be extremely difficultto use shrink wrap.

Applicants invention allows elimination of the inner seal and/or the external shrink band. Applicants invention blocks undetected access through the cap lid, so that without detection the lid cannot expose the dispenser orifice through which the product could be adulterated or used prior to sale. In addition, applicants invention prevents complete undetected removal of the cap which also would permit adulteration or removal of the contents.

BRIEF DESCRIPTION OF THE DRAWINGS

FIG. 1 shows a closure 12 employing a liner 14. As can be seen, the bottle neck 10 has a dispensing closure 12 attached to it and a liner 14 is included as part of the dispensing closure. The neck label or wrap 15 on this closure 12 ends below the edge of the lid 13 The inner liner 14 prevents tampering through the dispenser orifice 20. The neck label 15 also is adhered to the smooth neck 10 of the bottle with normal adhesive so that it is not removable and if the closure 12 is removed from the neck of the bottle 10 the neck label 15 will be torn. If the lid 13 of the cap 12 is lifted, the liner 14 prevents introduction of adulterants through orifice 20 and if this liner 14 is damaged tampering will be evident.

FIG. 2 shows a dispensing closure 11 without any liner. The closure is of a similar type to FIG. 1 which fits on bottle neck 10. There is no inner liner or seal however. The neck wrap 15 extends from the smooth bottle neck 10 up over the edge extension 17 of the movable lid 13 of the dispenser cap 11. The wrap 15 thus provides the dual function of preventing undetectable tampering either by removing the dispenser closure 11 completely or by opening the lid 13 of the closure 11 to introduce an adulterant into the dispensing orifice 20. This method eliminates the requirement of an inner seal which results in a considerable cost savings.

FIG. 3 shows a bottle together with a dispenser closure 12 and a neck wrap 15 of the invention. The edge extension 17 of the lid 13 is shown to advantage. The wrap 15 covers this edge extension 17 to prevent lifting the lid 13 and to prevent removal of the closure 12 from the container.

Figure 1:
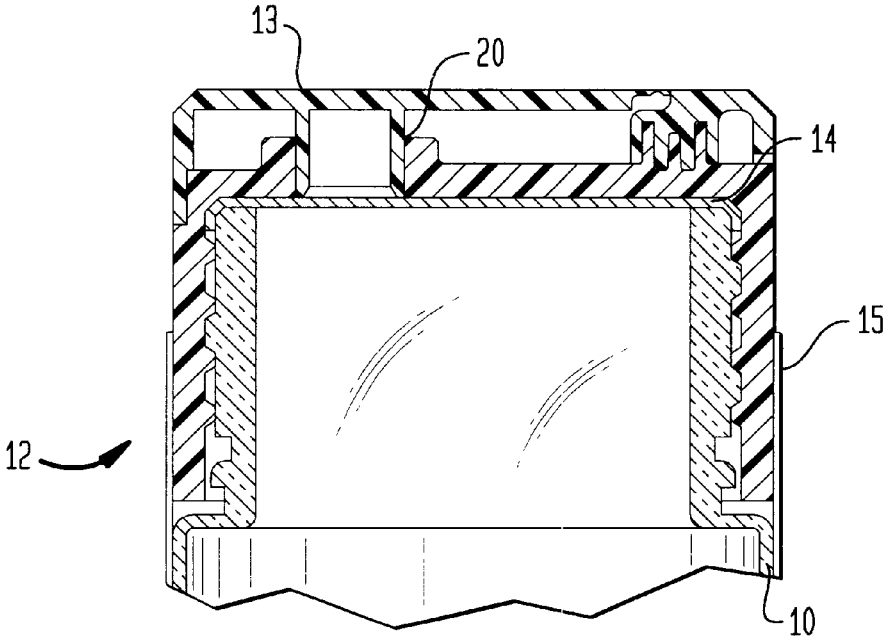
FIG. 1 (PRIOR ART)
FIG. 1 is a representation of the prior art cap.
Figure 2:
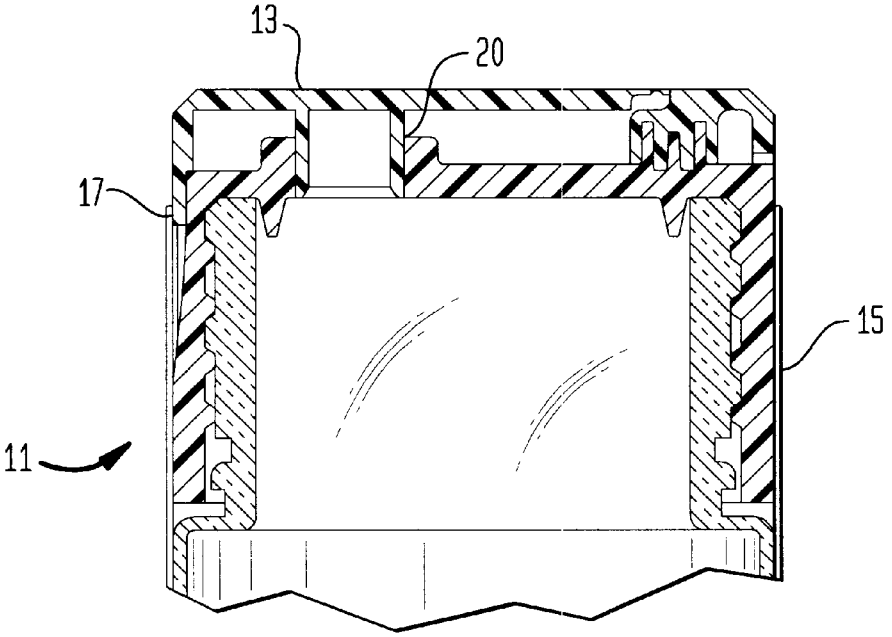
FIG. 2 is a representation of the cap of the invention.
Figure 3:
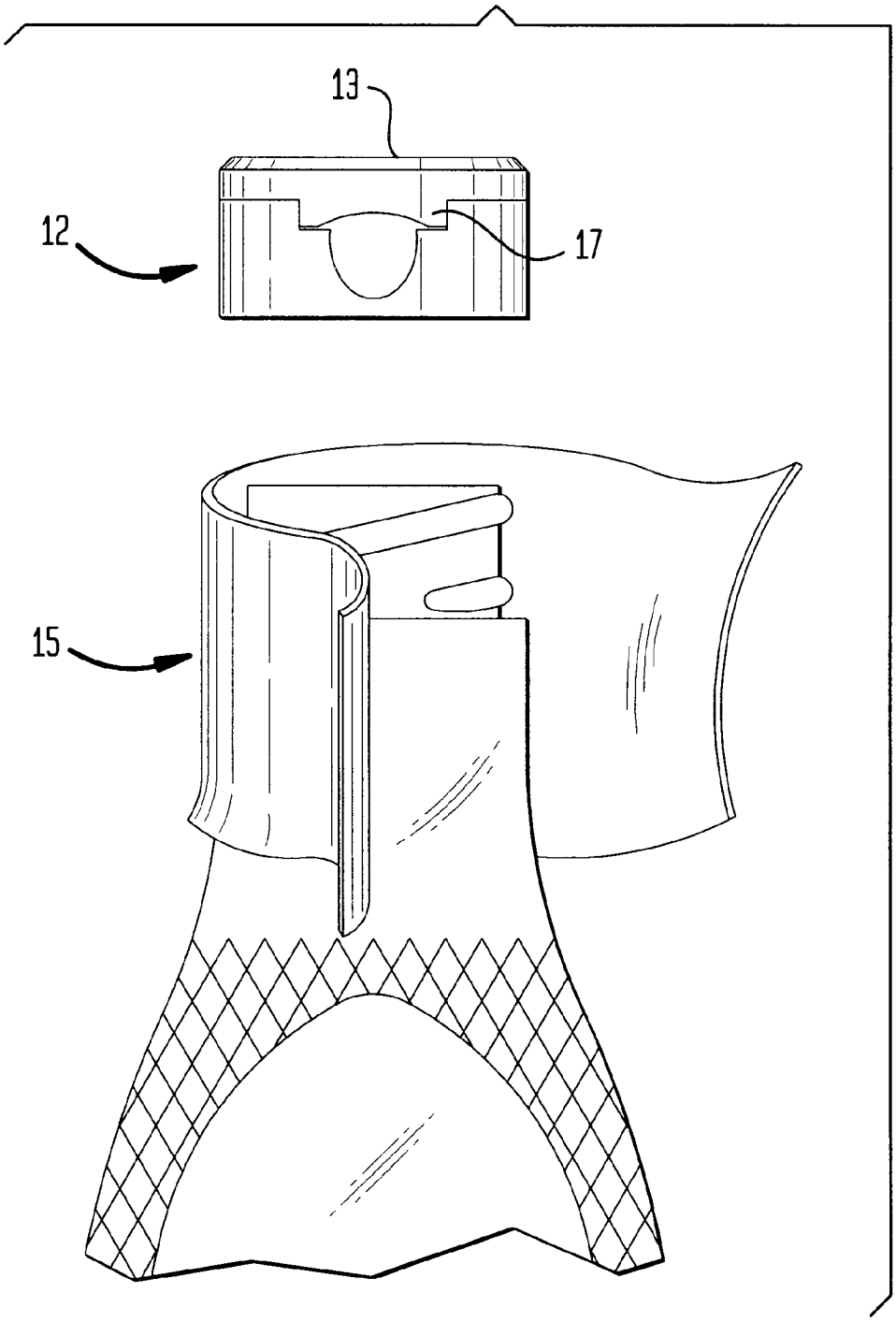
FIG. 3 is an exploded view of the bottle, the wrap and the dispenser cap.

Although this invention has been described with respect to the preferred embodiments thereof, variations and modifications will be readily apparent to those skilled in the art without departing from the spirit and scope of the invention as set forth in the claims.

What is claimed is:

1. A container having a smooth neck portion and having a removable dispenser closure mounted on the neck, said closure being formed of a top, a skirt depending from the top in the same curved plane as the neck and a dispensing lid mounted on the top, said top having a dispensing orifice therein communicating with the interior of the neck of said container, said lid being movable from a position closing the dispensing orifice to a position opening said dispensing orifice and a tamper evident paper neck wrap mounted on said container and holding said skirt to said bottle said dispensing lid having an integral edge extension in the same curved plane as the neck, said edge extension being sufficiently long to extend under said wrap to prevent said dispensing lid from being moved to the open position without tearing or breaking the neck wrap.

2. A container as defined in claim 1, wherein said wrap is a paper label.

* * * * *